US005964469A

United States Patent [19]

Grossman et al.

[11] Patent Number: 5,964,469

[45] Date of Patent: Oct. 12, 1999

[54] WHEELS FOR INLINE ROLLER SKATES

[75] Inventors: Richard D. Grossman, Grenada Hills; Duncan G. Robins, Woodland Hills, both of Calif.

[73] Assignee: Jas. D. Easton, Inc., Van Nuys, Calif.

[21] Appl. No.: 08/845,498

[22] Filed: Apr. 24, 1997

[51] Int. Cl.[6] ..... B60C 7/24

[52] U.S. Cl. ..... 280/11.22; 301/5.3

[58] Field of Search ..... 280/11.2, 11.23, 280/11.22, 11.19; 301/5.3, 5.7

[56] References Cited

U.S. PATENT DOCUMENTS 5,346,231 9/1994 Ho ..... 280/11.2

5,667,280 9/1997 Hansen ..... 301/5.3

*Primary Examiner*—Richard M. Camby

*Attorney, Agent, or Firm*—Flehr Hohbach Test Albritton & Herbert LLP

[57] ABSTRACT

A roller skate wheel is described wherein the weight of wheel is significantly reduced by employing a bushing bearing instead of the usual ball bearing in at least one side of the wheel. The bushing is formed of Peek material so as to provide the necessary strength and low friction necessary to provide desirable skating characteristics.

2 Claims, 2 Drawing Sheets

WHEELS FOR INLINE ROLLER SKATES

BACKGROUND OF THE INVENTION

This invention relates to tandem, or inline, roller skates and particularly those which are suitable for playing hockey. Hockey has long been a popular game on ice and, of course, hockey players are most familiar with ice skates and with the particular type of ice skates used in playing hockey. Such hockey ice skates provide a great deal of maneuverability permitting the skater to change directions and to stop quickly. This is in contrast with the usual recreational ice skating as well as the usual recreational inline roller skating.

The majority of inline roller skates on the market over the past twenty years have been developed primarily for leisure skating outdoors over large cracks in pavement. The wheels were designed large enough to roll easily over most of the cracks in the pavement but not so large as to raise the skater too far above the ground. Two steel ball bearings were used in each wheel to support the loads. The frames holding the wheels to the boots were designed with supports on both sides of the wheels to increase the strength of the skate. For the most part, the hockey inline roller skates of the prior art have been designed substantially like recreational inline roller skates, although some designs have been lighter than others.

The typical construction results in skates which are extremely heavy and difficult to maneuver when playing inline hockey, figure skating or stunt skating. Subsequent attempts to lighten the skates have made the resulting skates too slow, because of increased friction or, subject to failure because they were not sufficiently robust. Even so, inline roller skates have been used for playing hockey for over twenty years; see, for instance, U.S. Pat. No. 3,880,441 for a tandem roller hockey skate.

One of the principal differences between playing hockey with inline roller skates as opposed to ice skates, is the manner in stopping. In ice skating, the skater ordinarily comes to a quick stop by shifting the blade of his skates to a direction perpendicular to the direction of movement and then leans back, thereby providing sufficiently high friction scrapping along the ice so as to come to a complete stop. With inline roller skates, the usual manner of stopping in the past has been to use a brake snubber on the heel or toe of the boot to provide friction while the skate is still directed in the line of movement.

Many users of inline hockey skates attempt to stop in the ice skating manner using normal roller blade wheels. However, that is a difficult maneuver to master. The application of braking action in the ice skating manner is hard on inline roller skates since the force of braking is applied directly to the wheels, bearings and axles. In most instances, inline skate axles are supported by brackets on each side of the wheel and the braking force is thereby applied evenly to the two ends of the axles and the loads are distributed over the two ball bearings in each wheel. This configuration, however, is heavy and clearly limits the degree of "lean over" the skater can employ without having the bracket itself contacting the skating surface. To avoid the latter problem, some inline roller skates employ a cantilevered axle secured to a downward extending bracket on only one side of the wheel. In such instances, the force of braking in the ice skating manner provides a lever arm tending to bend the axle upwardly from the bracket and produce a substantially magnified force against the axle. In such instances, the axle, as well as the wheel structure itself, must be sufficiently strong to withstand any such forces. To date, skates using such cantilevered axles have been too heavy to provide the desired maneuverability. Much of that weight has been in the wheel structure itself which ordinarily includes a pair of ball bearings for each wheel so as to provide the necessary strength to resist the braking forces.

BRIEF SUMMARY OF THE INVENTION

The wheels for inline hockey skates as described herein are such as to provide the necessary strength as well as the light weight which is so necessary in providing the ideal hockey inline skate. Even with a larger number of wheels than the usual four or five wheels of the prior art, the weight of the frame/wheel combination is reduced by as much as 30% without compromising strength and performance characteristics. Moreover, the wheels according to the invention allow for a more maneuverable design. In accordance with the invention, the weight may be reduced by eliminating at least one of the two bearings ordinarily utilized in roller blade skate wheels. In the prior art, two steel ball bearings are employed, one on each side of the wheel with spacer in between. In applicant's construction, at least one of the bearings is replaced with a bushing type bearing formed of a material providing not only the necessary strength and light weight, but also the necessary low friction with the axle.

BRIEF DESCRIPTION OF THE DRAWING

Additional objects and features of the invention will be more readily apparent from the following detailed description and appended claims when taken in conjunction with the drawing, in which:

DESCRIPTION OF THE PREFERRED EMBODIMENTS

Figure 1:
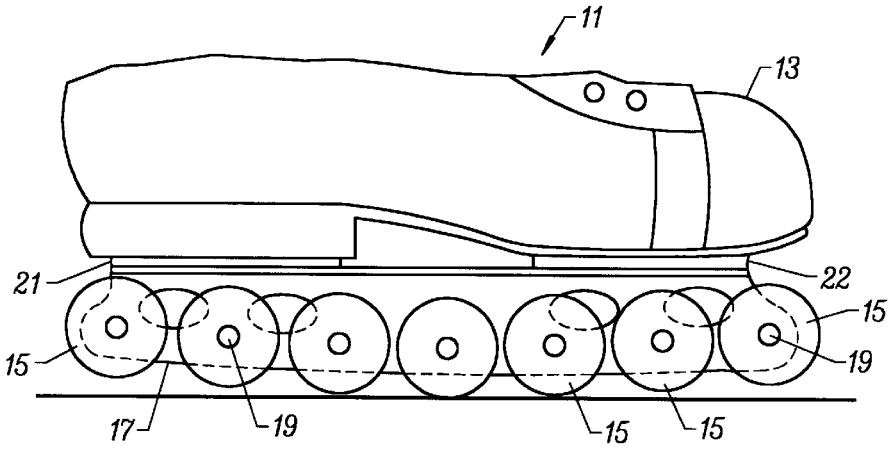
FIG. 1 is a side view of an inline skate having wheels in accordance with the invention.
Figure 2:
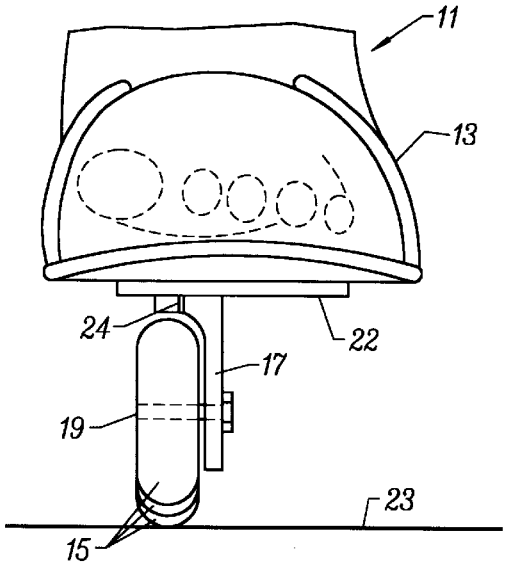
FIG. 2 is a front view of the skate shown in FIG. 1 with the skate in its normal vertical skating position.

Referring now to FIG. 1, there is shown an inline roller skate 11 including the usual boot 13 with a series of wheels 15 rotatably secured to a frame 17 by means of axles 19. The boot 13 is secured to the frame 17 by means of heel and toe plates 21 and 22. The heel and toe plates 21 and 22 may be secured to the frame 17 by means of screws 24 alone or by a combination of screws and an adhesive. Preferably, the frame 17 and the heel and toe plates 21 and 22 are formed of a high strength non-ferrous alloy or a composite sheet. Exemplary non-ferrous materials include 7075 or 6061 aluminum with T6 treatment. Such composite sheets may include one or more materials such as Kevlar (a registered trademark of E.I. DuPont de Nemours & Co.), graphite and long glass fibers. As seen particularly in FIG. 2, the wheels 15 are disposed on a frame 17 so as to lie toward the inside of the skaters foot. Thus, when the skater leans over for braking action as shown in FIG. 3, there is no interference with the skating surface 23.

Figure 3:
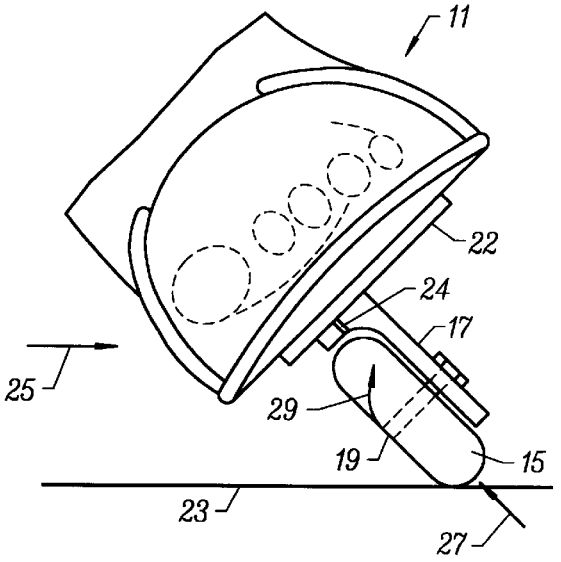
FIG. 3 is also a front view of the skate shown in FIG. 1 but with a skate in a significant lean over condition such as is used while braking in the ice skate manner.

As shown in FIG. 3, the skater has leaned over by an angle of about 45 degrees and the direction of the sliding/braking travel is as shown by the arrow 25. The braking action causes a force on the axle 19 in the direction of the arrow 27 thereby causing the axle to act as a lever arm with a tendency to bend at the end as shown by the arrow 29.

Figure 4:
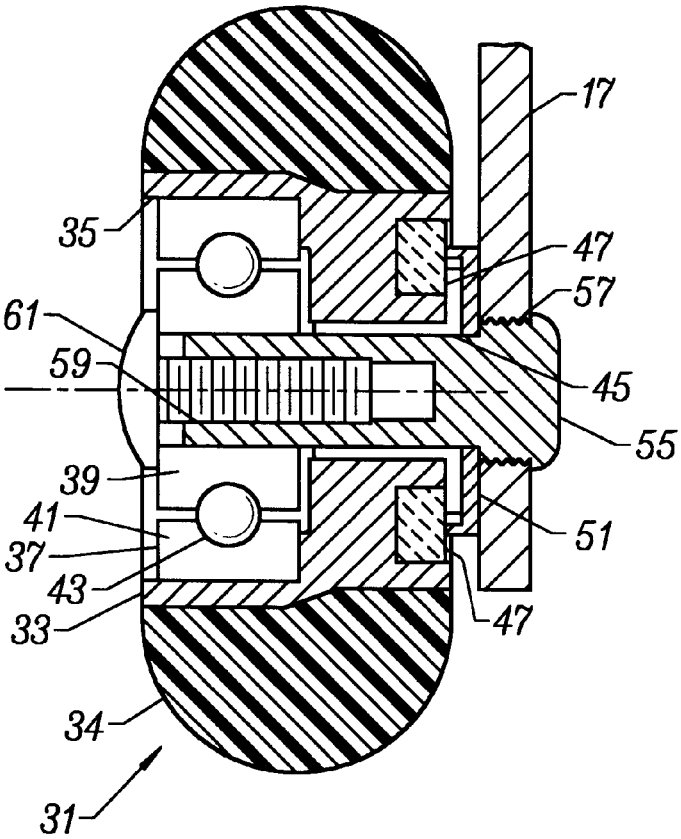
FIG. 4 is a cross-sectional view of a wheel in accordance with the invention employing the combination of a bushing type and a ball type bearing.

Referring now to FIG. 4, a preferred form of wheel in accordance with the invention as shown. Specifically, the wheel 31 includes a hub 33 to which a tire 34 is bonded in a known manner. The hub 33 has an axial recess 35 for receiving a ball-bearing 37. The ball-bearing 37 includes the usual inner and outer races 39 and 41 as well as a series of balls 43. At the opposite side of the wheel, a bushing 45 is employed rather than a ball-bearing. The bushings are available from the Igus Company of East Providence, R.I. under the name T500-Series Bushing. Such bushings have high temperature resistance and high load capacity. With such a combination of a ball-bearing and a bushing, the ball-bearing serves to withstand the force of braking action, while on the opposite side of the wheel, the bushing serves to provide a much lighter bearing surface which also provides a low friction somewhat equivalent to that of the ball bearing. The friction is further reduced merely by nickel plating the axles 19 or by applying a coating such as WS-2 (titanium disulfide) over the nickel plate. Packing 47, fabricated by die cutting a soft graphite sheet into rings, may be employed in conjunction with a cup 51 to act as a dust shield.

The wheel 31 is secured to the frame 17 by an axle 55 having threads 57 cooperating with corresponding threads in the bracket 17. In addition, the axle 55 has a threaded bore 59 to receive a screw 61. The threads 57 and 59 are oppositely handed—thread 57 being left handed and thread 59 being right handed. Tightening of the screw 61 to capture the wheel 15 onto the axle 19 causes simultaneous tightening of the axle threads 57 into the frame 17.

Figure 5:
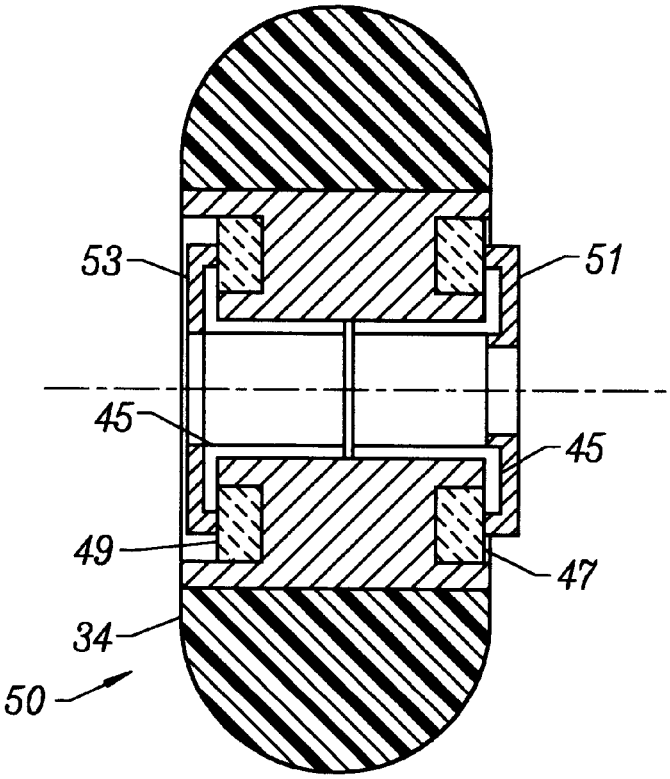
FIG. 5 is a cross-sectional view of a wheel in accordance with the invention utilizing only bushing type bearings.

In order to provide an even lighter wheel with greater maneuverability, the ball-bearings may be eliminated entirely as shown in the embodiment of FIG. 5. In FIG. 5 a wheel 50 is shown wherein bushings 45 are employed on both sides of the wheel and there is no ball-bearing at all. Packing 47 and 49 may be employed in conjunction with cups 51 and 53 to act as dust shields. In other respects, the wheel 47 and its attachment to the frame 17 is the same as for the wheel 31 shown in FIG. 4. Again, the T-Series Bushings of the Igus Company prove satisfactory in providing sufficient resistance to the braking forces as well as adequate friction reduction.

We claim:

1. An inline hockey skate comprising:

a frame adapted to be secured to the sole of a boot: said frame defining an axle hole;

a hub having a tire secured thereto;

said hub including an axial bore and two end faces;

a ball bearing disposed in said bore at one of said end faces and a bushing bearing disposed in said bore at the other of said end faces; and an axle bolt extending through said axial bore of said hub and said axle hole in said frame.

2. An inline hockey skate comprising:

a frame adapted to be secured to the sole of a boot, said frame defining a threaded axle hole;

an axle bolt threaded into said axle hole, said axle bolt including a threaded bore;

a wheel having a hub and a tire secured to said hub, said hub including an axial bore and two end faces;

a ball bearing disposed in said bore at one of said end faces and a bushing bearing disposed in said bore at the other of said end faces;

said wheel being disposed on said axle bolt, and a screw threaded into said threaded bore of the axle bolt securing said wheel onto said axle bolt.

* * * * *